United States Patent [19]

McMullan et al.

[11] 4,022,349

[45] May 10, 1977

[54] MUD HEATER AND PUMP THEREFOR

[76] Inventors: James P. McMullan; Kermit E. Giddens; Melville E. Borst, all of 2630 Seaman, El Monte, Calif. 91733

[22] Filed: Aug. 11, 1976

[21] Appl. No.: 713,274

[52] U.S. Cl. ..... 222/54; 222/146 HE; 222/334; 432/43

[51] Int. Cl.[2] ..... B67D 5/14

[58] Field of Search ..... 222/54, 146 H, 146 HE, 222/146 HS, 334; 432/43, 44

[56] References Cited

UNITED STATES PATENTS 3,006,507 10/1961 Bauerlein ..... 222/54

*Primary Examiner*—Stanley H. Tollberg
*Assistant Examiner*—Hadd Lane
*Attorney, Agent, or Firm*—Georges A. Maxwell

[57] ABSTRACT

Apparatus for tempering drilling mud preparatory to testing the mud for petroleum content comprising a plurality of cylinders with heat-sinks about their exteriors, resistance heaters in the heat-sinks and temperature control means related to the heaters and heat-sinks, pistons engaged in the cylinders and shiftable longitudinally therein to draw mud into and drive mud out of the cylinders, valve controlled flow means connected with and between the cylinders and upstream and downstream sections of a mud conducting flow line and operable to conduct mud from the upstream section into the cylinders and from the cylinders to the downstream sections and operable by pressure differentials in the cylinders resulting from the movement of the pistons therein, drive means to move the pistons and means controlling operation of the drive means and responsive to the temperature of mud in the cylinders, the pistons operate to wipe and displace mud caked on the walls of the cylinders to be recombined with fluid mud, whereby fouling of the apparatus and alteration of the mud to be tested is prevented.

9 Claims, 6 Drawing Figures

MUD HEATER AND PUMP THEREFOR

This invention has to do with a novel heating apparatus and is particularly concerned with an apparatus for heating oil well drilling mud preparatatory to testing the mud for petroleum content.

In the course of drilling oil wells circulating mud, generally composed of collodial clay (such as bentonite clay) and water or a water and/or oil emulsion, is circulated downwardly in a drill pipe, through a formation cutting or milling bit at the lower end of the pipe and thence upwardly through the annulus between a well bore and the pipe, to be discharged at the top thereof. The mud serves to establish a lubricous coating on the well bore for the pipe and serves to carry cuttings established by the bit upwardly through and from the top of the well.

The circulating mud discharged from the well is deposited in a shaker screen or the like to remove the cuttings and prepare it for recirculation through the well structure.

In the course of the drilling oil wells, it is common practice to take samples of the drilling mud, as it leaves the wells and to test the samples to determine whether or not they are from oil bearing formations and, if so, the nature and quantity of the oil or petroleum products therein.

In practice, various mud sample testing means are employed. The most effective and efficient type of testing means is that type or class of means which is sensitive to petroleum volatiles and which is often referred to as a "sniffer " or "sniff tester".

Sniff testers of the nature or type referred to above are very effective and dependably record and/or indicate with resonable accuracy the amount of petroleum in a sample of drilling mud worked upon thereby. The major shortcoming to be found in sniff testers resides in the fact that in order to attain accurate results, the drilling muds must be at temperatures oftentimes greater than the temperature of the mud discharged from the wells. Accordingly, the mud samples to be tested must be heated to effect testing.

The above shortcoming is complicated and made worse by the tendency of drilling mud to cake or set up when it is subjected to heat for the purpose of tempering it for testing by means of sniff testers.

Attempts to heat drilling mud flowing through a flow line, for testing purposes, as by applying heat to and about the flow, results in the rapid build up of a hard clay cake at the heating surface. The clay cake builds up at a rapid rate to plug the flow line and also acts as an insulator which prevents desired tempering of the mud which continues to flow through the line.

As a result of the above, testing of drilling mud by sniff testers and the like requires the intermittent taking of samples of mud to be tested and the heating and testing of those samples in a separate piecemeal manner, utilizing what can best be described as laboratory techniques.

The tendency of drilling mud to set up and cake when heated has, prior to this invention, prevented the continous ongoing testing of such mud at a drill site, by any known and available testing means which requires heating of the mud.

The above noted tendency for drilling mud to cake and set up is believed and understood to be caused by the tendency for bentonite clay and other like coloidal clays used in drilling mud to rapidly separate from all excess water and to set up, coupled with the tendency for applied heat to drive oft and accelerate the separation of water from the clay.

It has been determined that during attempts to heat drilling mud in a flow line by applied heat to the line, the water content of the mud separates from the mud or clay in the heated portion of the line and flows freely downstream through the line, leaving the mud in the heated portion of the line to build up, set and or cake on the walls of the heated portion of the line. It has been determined that when a body of drilling mud is heated in a closed and/or sealed chamber, so as to prevent the water from being driven off and away, there is a slower build up and caking of clay and the cake which does develop does not appear to be as hard and difficult to reduce.

An object and feature of our invention is to provide a novel drilling mud heating apparatus which is such that it operates to effectively heat and deliver a substantially continuous sample flow of drilling mud, which is properly tempered for substantial continuous or ongoing testing for petroleum content.

It is another object and feature of our invention to provide an apparatus of the general character referred to having a plurality of heating cylinders and means for sequentially charging and discharging the cylinders with drilling mud flowing out of a well, whereby a substantial continous flow of sample drilling mud, properly heated for testing, is provided.

Yet another object and feature of our invention is to provide an apparatus of the character referred to wherein the mud is drawn into and is discharged from the cylinders by pistons which serve to effectively clean and strip the bores of the cylinders free of caked clay deposited therein by each charge of mud and preparatory to receiving another charge of mud thereby there is no accumulative build up of mud or clay within the cylinders and which would otherwise result in loss of heat transfer and effeciency.

Still another object and feature of our invention is to provide an apparatus of the general character referred to above wherein the cylinders are arranged within heat sink masses heated by means of electric resistance heaters whereby adequate heat, below a temperature which will reduce, bake or burn the clay and/or petroleum products in the mud, is stored about the cylinders for rapid heating of mud within the cylinders to that temperature which is necessary for testing the mud for petroleum content. (Obviously, this heating could also be accomplished by steam or other heat medium).

It is an object and feature of our invention to provide an apparatus of the character referred wherein the heat sink means is such that the electric heater means effectively and efficiently delivers necessary heat to temper the mud with minimum power consumption and with relatively constant uniform, non-fatiguing, operation.

The foregoing and other objects and features of our invention will be apparent and will be fully understood from the following detailed description of a typical preferred form and application of the invention, throughout which description reference is made to the accompanying drawings, in which.

Figures 1, 2, 3, 4:
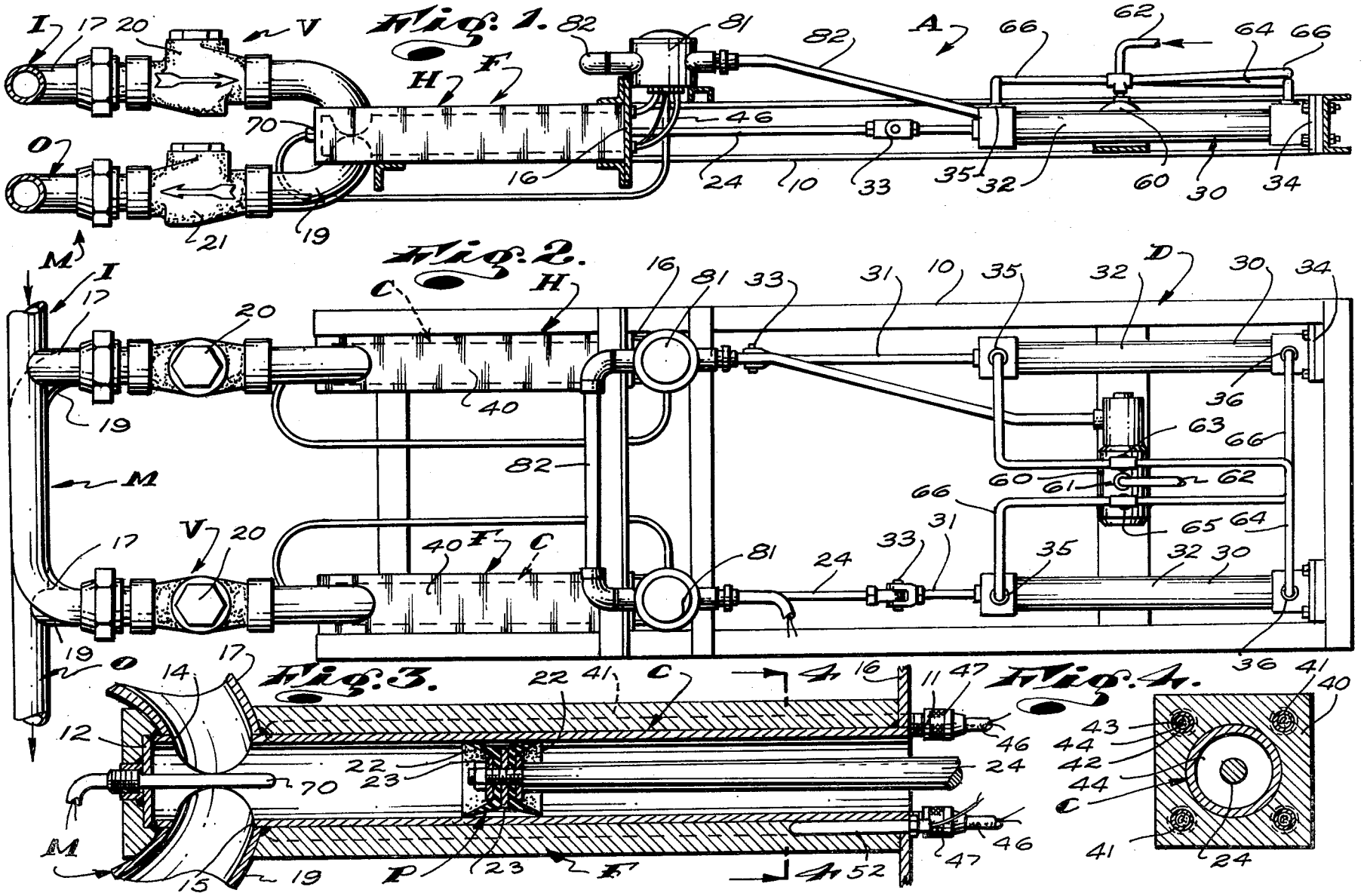
FIG. 1 is a side elevational view of the apparatus that we provide.
FIG. 2 is a top plane view of our new apparatus.
FIG. 3 is an enlarged detailed sectional view of a portion of the apparatus shown in FIGS. 1 and 2.
FIG. 4 is a sectional view taken substanially as indicated by line 4—4 on FIG. 3.

Referring to the drawings, the apparatus A that we provide includes, fluid or mud handling means F, drive means D for the means F, heating means H and control means E and G related to the means F and H.

The fluid or mud handling means F includes a plurality 2 of elongate cylinders C, carried by a frame 10, manifold means M conducting mud to and from the cylinders C, valve means V controlling the flow of mud into and out of the cylinders and through the manifold means M and pistons P shiftably engaged in the cylinders to draw mud into and expel mud from the cylinders.

The cylinders C are elongate units and are shown arranged in horizontal lateral spaced parallel relationship within the frame 10. The cylinders C have open rear ends 11 and closed forward or head ends 12 with lateral opposite inlet and outlet ports 14 and 15.

The cylinders C are established of steel or pipe and have smooth, preferably hone bores. The ports 14 and 15 are suitably cut in the sides of the cylinder adjacent the forward or heat end thereof, which end is closed by a simple plate secured thereto as by welding.

The rear ends of the cylinders are shown as including or provided with mounting plates 16 which are suitably fixed to the frame structure 10.

The manifold means M includes an inlet main or log pipe I with branch lines 17 extending to and communicating with the inlet ports 14 of the cylinders and an outlet main or log pipe O with branch lines 19 communicating with the outlet ports 15 of the cylinders.

The inlet log pipe I has a free inlet end which connects with suitable source or supply S of mud to be worked upon.

The outlet log pipe O has a free discharge end which is adapted to deliver (directly or indirectly) mud worked upon to a suitable testing device or means T. (see FIG. 5 of the drawings).

The means M is established of suitable steel pipe or tube sections suitably formed and welded together, substantially as illustrated.

The valve means V includes inlet check valves 20 in the inlet branch lines 17 of the means M, which valves permit the free flow of mud through the log I and the lines 17 into the cylinders and outlet check valves 21 in the outlet branch lines 19 which permit the free flow of mud out of the cylinders through the lines 19 and the log O. The valves 20 and 21 can be any one of several suitable standard commercially available check valves.

The pistons P can be of any suitable form and construction. In the case illustrated, the pistons are in the nature of double acting pistons comprising forwardly and rearwardly opening cylinder engaging rubber cups 22 with front, central and rear backup plates 23 related thereto. The noted assembly of cups and plates is suitably secured to the forward end of elongate piston rods 24, which rods are concentric and extend free from and into the open rear ends of the cylinders C.

The double acting cup type pistons here provided are desirably since they effectively seal with the cylinder bore upon both forward and rearward movement and are such that the cups serve to effectively wipe mud or clay from the cylinder bores and to move such mud in advance thereof.

Upon rearward movement of the pistons in the cylinders, mud or clay wiped from the cylinder bores is effectively advanced and moved to the open rear ends of the cylinders where it is free to be discharged or dropped therefrom. Accordingly, by having the rear ends of the cylinders open, the possibility of the rear ends of the cylinders becoming plugged and fouled with solids is eliminated.

The drive means D for the pistons includes any number elongate double acting cylinder and ram units 30 for each cylinder C. The units 30 can be arranged in axial alignment with and in rearward spaced relationship from their related cylinders C, with rams 31 projecting freely forwardly from the cylinders 32 and coupled with the rear ends of their related pistons rods 24 as by means of semi-universal couplings 33.

The cylinders 32 of the units 30 are provided with mounting pads 34 at their rear ends secure them to the frame structure 10, substantially as shown.

The cylinders 32 have fluid conducting fittings 35 and 36 at their front and rear end portions to communicate with fluid supply ducts and to effect the flow of motive fluid into and out of the opposite ends of the units 30.

It is to be particularly noted and understood that the cylinder and ram units 30 can be hydraulic or pneumatic units, as desired, or as circumstances require. Further, their normal operating stroke is the same as or equal to the normal operative stroke of their related pistons P.

The units 30 can be any suitable standard commercially available hydraulic or pneumatic cylinder and ram unit. Those differences of design and construction which might exist between different makes of such units and any changes or modifications in the mounting and/or connecting of the units with their motive fluid supplies and/or controls and which materially differentiate from that which is illustrated in the drawings, in no way alters or affects the novelty and scope of our invention.

With mud handling means F and drive means D thus far described, it will be apparent that upon reciprocation of the pistons P in the cylinders C, mud is effectively drawn from the mud supply S through the log I, branch lines 17 and valves 20 into the cylinders C and is driven from the cylinders through the branch lines 19 and the valves 21 therein and thence into and through the log pipe O for delivery to the testing means T.

It will be further apparent that by sequential or alternate operation of the units 30 of the drive means D, a substantial uniform an constant flow of mud into, through and from apparatus A can be established and maintained.

The heating means H that we provide includes heat sink 40 about the cylinders and electric resistance heater units 41 in the heat sinks.

The heat sinks 40 can vary widely in construction but preferably in the nature and form of masses of metal, such as aluminum, having a high coefficient of heat conductivity and the ability to store heat. In practice, it is preferred that the metal or aluminum masses establishing the heat sinks 40 be cast about the cylinders C and about the heater units 41 to establish an intimate heat conducting bond and or contact between said masses and the cylinders and heater units.

The heat sinks 40 are of substantial longitudinal extent and are at least coextensive with the portion of the cylinder through which the pistons P travel and so that when the cylinders are fully charged with mud, the charges of mud are substantially wholly within the confines of the heat sink occurring about the cylinders.

In the case illustrated in FIGS. 1 through 4 of the drawings, the heat sinks 40 are coextensive with the cylinders and extend beyond and in overlying or covering relationship with the forward head ends thereof.

Figures 5, 6:
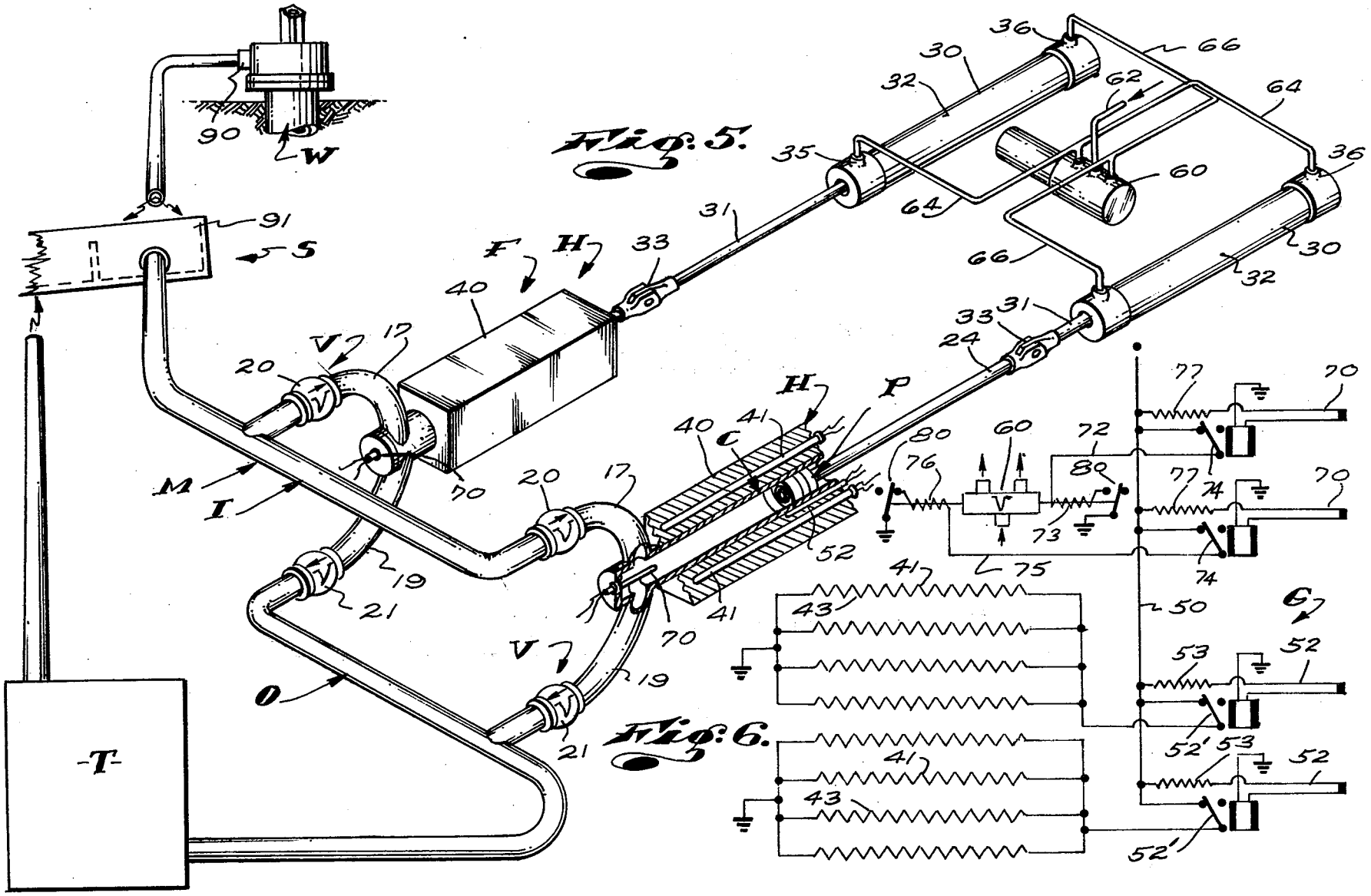
FIG. 5 is an isometric diagrammatic view of the fluid handling portions of our apparatus.
FIG. 6 is a circuit diagram.

In practice, if desired, and as shown in FIG. 5 of the drawings, the heat sinks can terminate rearward of the inlet and outlet ports in the forward end portions of the cylinders.

The extent and/or mass of the heat sinks and the heat storage capacity and conductivity of said sinks is such that they will store adequate heat to heat volume of mud in the cylinders in a short, desired, perdetermined period of time without having to be heated to a maximum temperatue which is equal to or greater than the temperature at which petroleum in the mud might be structurally modified, carbonized and/or create varnish like residue on the cylinder bores or to a temperature which is sufficiently high to result in any adverse structural modification and/or breaking down of the clay of the mud.

Accordingly, the heat sinks store, for ready conduction and release, a volume of evenly distributed low heat sufficient to elevate the temperature of a predetermined volume of mud to a desired increased temperature.

In practice, the heat sinks 40 can vary widely in form and construction. For example, the heat sinks could include bodies of suitable fluids contained in jackets about the cylinders C.

The heater units 41 are simple, conventional, commercially available industrial heater units. The units 41 are straight, elongate units with front and rear ends and are comprised of external metallic jackets 42, elongate resistance elements 43 supported within the jackets by suitable insulating material 44. The rear ends of the units are provided with longitudinally outwardly and rearwardly extending conductors for the elements 43. The conductors can, in practice, be in the nature of a simple contacts accessible at the rear ends of the units.

In the preferred carrying out of our invention and as shown in the drawings, each heat sink 40 is provided with a plurality of units 41 arranged in the heat sinks in radial and circumferential spaced, parallel relationship about the cylinders. The units 41 are bonded in the heat sinks 40 with the front ends terminating rearward of the front ends of the sinks and with their rear end portions projecting rearwardly from the rear ends of the heat sinks, a limited distance to provide free access thereto.

In practice, and as shown in the drawings, the units 41 are supplied with current through power lines 46 connected with the rear ends of the units by suitable fluid-tight and explosion-proof couplings 47.

The heating means H next includes power supply means G for the plurality of heater units 41 related to each cylinder C. The means G includes a power supply line 50 to supply current to the several units 41, a normally closed relay switch 52 in the line 50 and a thermocouple 52 operatively connected with the relay switch. The thermocouple 52 is shown as a simple elongate probe-type thermocouple arranged in the heat sink 40 of its related cylinder C and adjacent the exterior of the cylinder. The thermocouple 52 has a free end extending from the rear end of the heat sink and cylinder assembly and from which its conductors extend. in FIG. 6 of the drawings, we have shown a simplified circuit wherein the operating current for the relays is established by a resistor 53 connected with and between the thermocouples and the line 50.

The thermocouples 52 are operative to conduct operating current to and to effect opening of the relay switches 52 when the temperature of the heat sinks and cylinders reach a maximum allowable temperature whereupon the heater units are de-energized and the sinks and cylinders are not let to become overheated.

It is to be particularly understood that the circuit of the means G is, as above noted, a simplified circuit and that in practice any one of a number of more complicated circuits better suited for attaining the desired operative end results can be employed in carrying out our invention, without departing from the spirit thereof.

The apparatus here provided next and finally includes the above noted means E for controlling the operation of the drive means D for the fluid handling means F. The means D includes a solenoid operated, two positioned, four way selector valve 60 with a fluid inlet fitting 61 to connect with a line 62 extending from a source of high pressure motive fluid or air (not shown). The valve 60 next includes a first delivery fitting 63 connected with the fitting 35 of one cylinder and ram unit and with the fitting 36 of the other cylinder and ram unit as by lines 64 and a second delivery fitting 65 connected with the fitting 36 of said one cylinder and ram unit and the fitting 35 of said other cylinder and ram unit as by lines 66, whereby motive fluid is delivered to the front end of one and to the rear end of the other of the units 30 and fluid flows from the rear end of said one and from the front end of said other of the units 30 when the valve 60 is in one position (and vice-versa).

With the above relationship of parts, when the valve 60 is in one position, one unit 30 is operated to drive its related piston forward and discharge mud from its related cylinder and the piston P related to the other unit 30 is driven rearwardly to draw mud into its related cylinder, and vice-versa.

The means E next includes a probe-type thermocouple 70 carried by the forward end of each cylinder C and extending rearwardly into the forward portion of the cylinders to sense the temperature of the mud in the cylinders and having service ends accessible at the exterior of the forward ends of the cylinders C. The thermocouple 70 related to one cylinder C is connected with a normally open relay switch 74 engaged in a line 72 extending from the power supply line 50 to one coil 73 of the solenoid operated distributor valve 60 and the thermocouple 70 related to the other cylinder C is connected with a normally open relay switch 74 engaged in a line 75 extending from the power line 50 and to a second coil 76 of the valve 60. The thermocouple 70, like the thermocouples 52 of the means G are operable to conduct operating current to the related switches 74 when they are heated by the mud in the cylinders C to a predetermined temperature and are supplied with operating current by or from resistors 77 connected with the primary power of line 50, as shown in FIG. 6 of the drawings.

With the above relationship of parts, it will be apparent that when one cylinder C has been charged with mud and the mud has been heated to a predetermined temperature, the valve 60 and the means D are operated to effect discharge of that heated mud from that cylinder and to simultaneously cause a new charge of mud to be drawn into the other cylinder to be heated.

When the above noted new charge of mud is heated in the said other cylinder, the noted cycling of the apparatus is repeated, discharging the noted new charge of mud and recharging the first cylinder with mud to be heated.

Since heated mud in cylinders C remain in the forward portions thereof and about the thermocouple 70 when the mud is discharged from the cylinders and since that residual heated mud would cause operating current to continue to flow to the coils of the valve, means is provided to cut off the flow of operating current to each coil following energizing thereof and resulting operation of the valve 60. In the case illustrated, the switch 80 is provided at or in the ground line for each valve coil. The switches 80 are operatively coupled with the armature of their related coil, whereby the switches are open when the armature or armatures are in one position or the other. The switches 80 are so set and arranged that the circuit for each coil is open and the coil is de-energized following energizing on the coil and resulting movement of its related armature from an unactuated to a fully actuated position.

It is to be understood and will be readily apparent that the solenoid operated valve 60 that we provide is not a special manufactured valve but rather can be any desired suitable standard and commercially available solenoid operated distributor valve. Accordingly, the structure of the fluid handling means and electrical operating means for the valve 60 is subject to wide variation. The variations in commercially available distributor valves suitable for use in our apparatus are such that many require extensive changes to be made in the operating circuitry therefor or the provision of special electrical circuits to effect their satisfactory operation. Such changes in or the provision of special circuits for the apparatus are made or provided as circumstances require with the exercise of choice and ordinary skill and in no way alter or affect the broader aspects of our invention.

In accordance with the above, and since the circuit or circuits which are likely to be employed in carrying out our invention are subject to wide variation, we have, for the purpose of this disclosure, elected to illustrate and have described simplified circuits which are believed to be effective to illustrate a basic function and end to be attained.

In the preferred carrying out of our invention and to meet existing safety codes and the like, the circuitry and wiring for the apparatus is enclosed in explosion proof boxes 81 and extends through protective conduits 82 such as is illustrated in FIGS. 1 and 2 of the drawings.

In practice, and as diagrammatically illustrated in FIG. 5 of the drawings, the apparatus A is located at a well drilling site in close proximity to the drilling mud discharge or outlet 90 of a well W and/or to a shaker screen 91 into which mud flowing from the well is deposited and worked upon to condition it for recirculation through the well. The outlet log pipe I is suitably connected with the discharge 90 or with the shaker 91 to conduct that sampling portion of mud drawn into the apparatus during normal operation thereof. In practice, the log pipe I can connect and communicate directly with the supply of mud or can be indirectly connected therewith as by means of an extension pipe, a hose or the like.

The outlet log pipe O is connected and communicates with the sample testing means T for which the sample mud is to be tempered. The pipe O can connect directly with means T or can be connected therewith, indirectly, by means of an extension pipe, hose or other suitable means and as circumstances require.

The sample mud, after being tested by the means T, can be saved for record puposes or can be returned to the shaker 91, as desired, or as circumstances require.

The testing means T can vary widely in practice. That testing means T for which the apparatus A was particularly designed and with which the apparatus A has been effectively used is known to applicant and is referred to in the art as a "Mud Mixer and Gas Chromatograph". Such testing means are old and well known in the art and, depending on their vintage and their fabricators, vary considerably in the details of construction.

The apparatus A is such that the temperature of the sample should be about 100° F. In the event the mud flowing from the well W is, for example, 60° F., the temperature of the mud must be elevated 40° by the apparatus A.

In practice, the temperature of the sample mud should not be let to exceed 212° F. (the boiling temperature of water), since at that temperature the structure of the mud is modified and adversely affected. Further, the temperature of the cylinder walls should not be let to exceed 230°, since at that temperature the structure of the clays used in establishing the drilling mud is frequently adversely affected and the petroleum in the mud tends to break down, burn and establish fouling varnishes and the like in the apparatus.

The above noted temperature limits and the effects likely to occur if they are exceeded are not fixed and always the same, but are indicative of safe maximum limits and of the nature of effects that can be expected if such limits are exceeded. In practice, it is possible that adverse fractioning of some sample muds may occur at 210° F. or may not occur until the temperature of the mud reaches 250° F.

In accordance with the above, it can best be said that the temperature of the mud and/or cylinders should not exceed the predetermined fractioning temperature of the mud, it being understood that the temperature, while generally about 212° F. is the subject to substantial variations.

In operation, when the apparatus is set up as shown in the drawings and described above, the heating units are energized to heat the heat sinks 40 and cylinders C to the predetermined maximum non-fractioning temperature of the mud. The thermocouples 40 are established or set to control the power to the heater units so that the power to the units is shut off when the noted predetermined temperature is reached and is turned on when the temperature of the heat sink and cylinders drops off or falls below said predetermined temperature, whereby the heater units serve to maintain the heat sinks and cylinders at said predetermined temperature throughout operation of the apparatus.

When the piston P in one cylinder is moved from its forward position to its rearward position in its related cylinder, it draws a charge of cold mud from the supply S and through the means M into the cylinder. The charge of cold mud draws stored heat from the cylinder and its related heat sink and the heating units are energized to replace heat thus lost by the heat sink and cylinder.

In practice, the mass of the highly conductive heat sinks is sufficiently great in comparison to the volume of mud to be heated in the cylinders that there exists an abundance of ready heat and the heating of a charge of mud results in little drop or fluctuation in the temperature of the heat sink.

When the temperature of the mud in the above referred cylinder C, at and about the thermocouple 70, reaches the desired testing temperature, for example, 120° F., the piston P is caused to move forwardly to force and discharge the heated mud from the cylinder through the means M for delivery to the means T.

When the above noted piston is operated to discharge heated mud from its related piston, the piston related to the other cylinder which was previously moved to its forward position to discharge heated mud, is moved rearwardly to draw in a new charge of cool or cold mud to be heated and then discharged in the same manner as the first above noted cylinder and piston.

It is to be particularly noted that, upon each forward stroke above the pistons, mud or clay adhering to the bores of the cylinder C in advance of the pistons is effectively wiped or stripped from the bores by the pistons to recombine with the heated mud as it is being discharged.

It is extremely significant and it is important to note that each charge of mud in the cylinder C is sealed and held captive therein, whereby all of the materials going up to make up each charge of mud are retained and kept together in intimate and close proximity with each other, within the confines of the cylinders and are not free to escape and become separated and/or so displaced that the composition of the heated mud flowing from the apparatus is altered or modified to any noticeable extent. That is, no water or water vapor and no petroleum volatiles are permitted to escape or become so displaced in each charge of mud heated by the apparatus so that the flow of mud from the apparatus is appreciably different from the flow of mud into the apparatus.

In the event that materials established in the mud should separate when in the cylinders C, the action of the pistons urging the mud from the cylinders and the flow of the mud through the outlet check valves 21 effectively and dependably mixes and recombines the materials so that they are in essentially the same relative condition as they were upon entry into the apparatus.

The above clearly distinguishes the instant apparatus from heating kettles or pots from which vapors and volatiles should be free to escape and from sealed heating pots and the like, wherein mud would be statically contained and in which the materials going to make up the mud would tend to separate and remain separated in such a manner as would adversely affect efforts to analyze the contents of the mud.

In practice, a single helically wound heater unit has been successfully employed in place of the plurality of separate heater units related to each heat sink and cylinder. The greater cost of such helically wound heater units is such that their use, in place of the plurality of straight, less expensive units, does not justify their use.

It will be readily apparent that in practice, if it is desired to establish a greater flow of tempered mud or it is desired to establish a more uniform or smoother flow of mud, the number of cylinders, with their related pistons, cylinder and ram units and the like, can be increased as desired, or as circumstances, without departing from the spirit of our invention.

While we have described the control means as operating to sequentially operate the cylinder and piston in a manner to establish and maintain a substantially constant flow of heater mud, there are instances when, due to the nature of the sniff testing apparatus, intermittent flow of heated mud is desired or preferred. In such instances, the control means is adjusted and or set so that the cylinder and piston units are synchronously operated, intermittently and so that the testing apparatus is supplied with charges of heated mud, intermittently.

Having described only a typical preferred form and application of our invention, we do not wish to be limited to the specific details herein set forth, but wish to reserve to ourselves any modifications and/or variations that may appear to those skilled in the art and which fall within the scope of the following claims:

Having described our invention, we claim:

1. A drilling mud tempering apparatus comprising a plurality of elongate cylinders with open rear sides and closed forward ends with inlet and outlet ports, an inlet pipe extending from a source of mud to be tempered and connecting means between the inlet pipe to the inlet ports of the cylinders, an outlet pipe to deliver tempered mud to mud testing means and connecting means between the outlet pipe and outlet ports of the cylinders, valve means to control the flow of mud in the inlet pipe into the cylinders and the flow of mud in the cylinders into the outlet pipe, pistons shiftably engaged in the cylinders, and having rods projecting rearwardly therefrom and from the cylinders, drive means for the pistons including cylinder and ram units spaced rearward from the cylinders and having rams drivingly connected with the rods, control means intermittently directing fluid from a source of motive fluid to the cylinder and ram units, whereby the pistons are shifted to draw mud into and discharge mud from the cylinders, heating means for the cylinders comprising heat sinks about the exteriors of the cylinders and electric resistance heater units engaging the heat sinks and control means comprising first thermocouples within the cylinders to sense the temperature of mud in the cylinders and connected with a control circuit for said control means whereby the cylinder and ram units for cylinders into which mud has been drawn are actuated to cause discharge of that mud when said mud has reached a predetermined temperature and second thermocouples to sense the temperature of the cylinders and connected with a power circuit to the heater whereby power to the heater units is shut off when the cylinders related thereto reach a predetermined temperature.

2. The apparatus set forth in claim 1 wherein said valve means include check valves at and controlling the flow of mud into and out of the inlet and outlet ports.

3. The apparatus set forth in claim 2 wherein said heat sinks comprise bodies of metal having high coefficient of conductivity cast about the cylinders.

4. The apparatus set forth in claim 3 wherein said heater units are metal jacketed resistance heaters arranged within and about which the heat sinks are cast.

5. The apparatus set forth in claim 4 wherein said pistons are double acting pistons with forwardly disposed cups engaging and wiping the bores of the cylinders when the pistons are moved forwardly therein.

6. The apparatus set forth in claim 1 wherein said heat sinks comprise bodies of metal having a high coefficient of conductivity cast about the cylinders.

7. The apparatus set forth in claim 6 wherein said heater units are metal jacketed resistance heaters arranged within and about which the heat sinks are cast.

8. The apparatus set forth in claim 7 wherein said pistons are double acting pistons with forwardly disposed cups engaging and wiping the bores of the cylinders when the pistons are moved forwardly therein.

9. The apparatus set forth in claim 1 wherein the cylinder and ram unit are double acting units and said control means includes electrically operated selector valve means selectively directing drive fluid to and from the cylinder and ram units and under control of the said control circuit and the said first thermocouples connected therewith.

* * * * *